United States Patent [19]

Schwing et al.

[11] 4,310,124

[45] Jan. 12, 1982

[54] MIXER FOR VISCOUS MATERIALS, FOR EXAMPLE FOR FILTER CAKE, PULP OR THE LIKE

[75] Inventors: Gerhard Schwing; Udo Pindras, both of Herne, Fed. Rep. of Germany

[73] Assignee: Friedrich Wilh. Schwing GmbH, Herne, Fed. Rep. of Germany

[21] Appl. No.: 98,824

[22] Filed: Nov. 30, 1979

[30] Foreign Application Priority Data

Dec. 5, 1978 [DE] Fed. Rep. of Germany ..... 2852499

[51] Int. Cl.[3] ..... B02C 13/24; B02C 18/06; B02C 18/18; B02C 18/40

[52] U.S. Cl. ..... 241/46.11; 241/258; 366/303; 366/307; 366/325; 366/330

[58] Field of Search ..... 366/190, 191, 195, 196, 366/293, 302–307, 325, 326, 330; 241/46.06, 46.11, 46.13, 46.17, 162, 258

[56] References Cited

U.S. PATENT DOCUMENTS

| | | | |
|---|---|---|---|
| 12 ,511 | 7/1906 | Lloyd et al. | 366/303 |
| 489,872 | 1/1893 | Monday | 366/307 |
| 946,610 | 1/1910 | Malmquist | 366/303 |
| 2,240,841 | 5/1941 | Flynn | 366/307 |
| 2,247,439 | 7/1941 | Hawes | 366/305 |
| 2,466,649 | 4/1949 | Van Halewijn | 366/190 |
| 3,709,664 | 1/1973 | Krekeler et al. | 366/307 |
| 3,938,783 | 2/1976 | Porter | 366/307 |

*Primary Examiner*—Philip R. Coe
*Assistant Examiner*—Timothy F. Simone
*Attorney, Agent, or Firm*—Andrus, Sceales, Starke & Sawall

[57] ABSTRACT

A mixer for viscous material has a plurality of rotating knife impellers which coact with stationary breaking knives in a cylindrical housing. The cylindrical housing has a converging portion containing guide ribs, stationary knives, and guide paddles. The shaft, in the converging portion, mounts helical ribbon segments and thrust paddles.

9 Claims, 6 Drawing Figures

MIXER FOR VISCOUS MATERIALS, FOR EXAMPLE FOR FILTER CAKE, PULP OR THE LIKE

Figure 1:
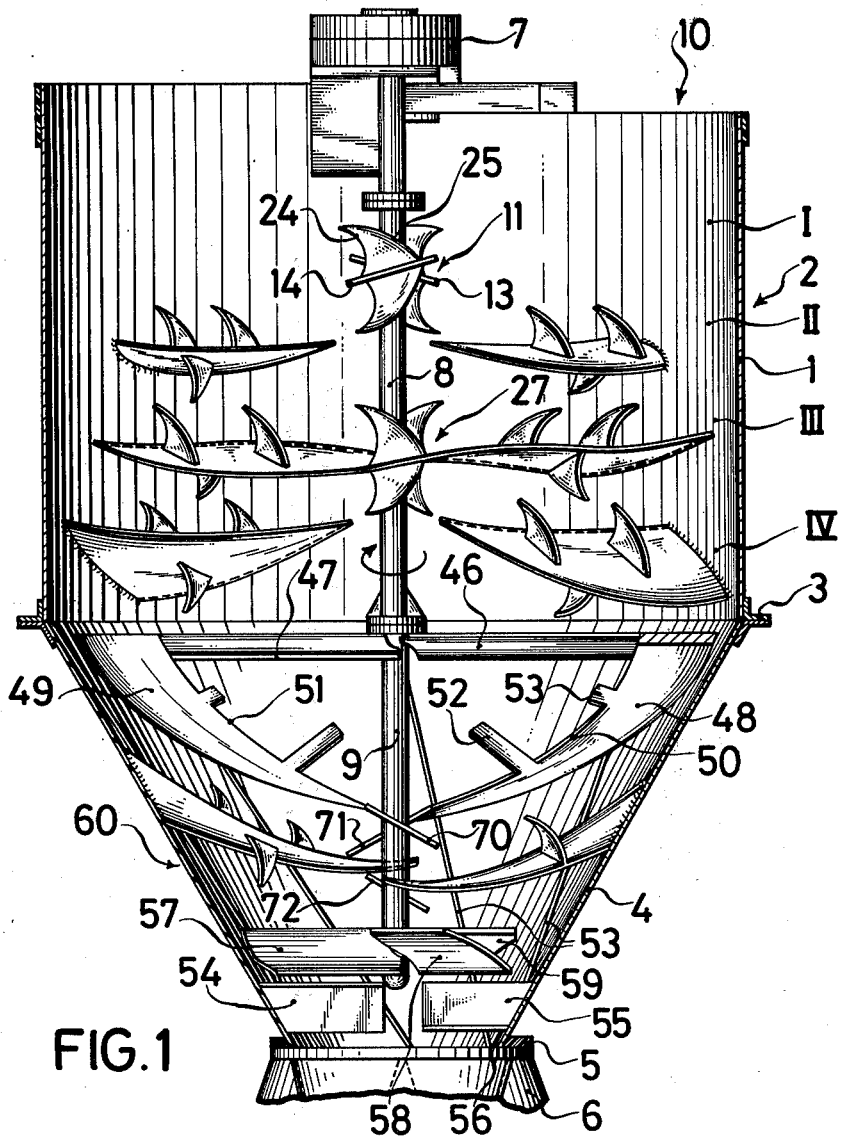

The invention relates to a mixer for viscous materials, for example for filter cake, pulp or the like with a stationary processing chamber, in which a shaft containing a mixing tool rotates.

The invention is particularly useful for mixing materials, which possess a proportionately small fluid component and thus are found in fragments, chunks or lumps. Such substances must frequently be transported before they can be additionally processed. The thorough mixing in these cases aims at the production of a conveyable, that is pumpable, discharge material from the output mass. For example, the invention is applicable to filter cakes that occur in filter presses or corresponding dewatered viscous materials, which must be delivered from precipitation vessel conveyor pumps, in order to be burned, for example. A further group of these viscous materials comprise pasty pulps ranging from the fibrous or chunky to the fragment condition. In particular, substances for consideration with the invention are those containing foreign bodies, which should be more or less intensely ground or comminuted before their further use. The mixer according to the invention, in these and other cases, can on the basis of its continuous action undertake the conveyance entirely or partly, for example through a pipe line, since one connects the mixer according to the invention immediately before a pump so its conveying output capacity is, under the circumstances, considerably increased through the tamping action of the mixer.

A two shaft reaction mixer is known, the shaft axes of which rotate parallel in the vat and are provided with paddle formed mixing elements. Such an apparatus is restricted in an agitation and aeration of the material undergoing treatment, is moreover, not suited as a rotary mixer and is not therefore considered for the working of large quantities of the viscous material.

Also known is a continuous screw mixer, which has under a feed hopper a worm conveyor with a fully threaded worm; the shaft of which extends in an adjacent housing portion, in which it is off set with paddles and the material conveyed to a discharge opening. With such apparatus the material undergoing treatment is formed into a concentrated body, which gyrates in the chamber. Then the passing through ceases so that the conveyance of the defluidized viscous material through pipe lines is not accomplished with this mixer.

The object of the invention is to provide a mixer that continuously conveys viscous material from an input opening to an output opening and in so doing mixes as well as comminutes foreign bodies if necessary, so that a substance further conveyable through pipe lines is delivered from the mixer.

According to the invention is this object achieved in that a plurality of plural vaned knife impellers serve as mixing elements which coact with stationary breaking knives arranged in planes between the planes of the knife impellers and that the shaft extends in a housing converging in the flow direction, in which are successively arranged guide ribs fastened to the housing, as well as stationary knives arranged in one on top of the other following radial planes, and guide paddles fastened to the housing, whereby ahead of the stationary knives are arranged helical ribbon segments fastened to the shaft and between the resulting planes of the housing fastened parts are arranged thrust paddles fastened to the shaft.

With this mixer the feed material must initially pass the knife impellers and the breaking knives coacting with them. There the material is comminuted, in the course of which material chunks as well as trapped foreign bodies are ground up. The material then passes to the converging housing part. There, the already previously mixed material from the helical ribbon segments is incorporated and further moved in the flow direction. As a consequence of the housing narrowing there results in this part of the mixer a desired thickening of the conveyed material. The ribs fastened on the housing oppose the movement of the material through a resistance on the housing wall, whereby the material is retarded at this place. Consequently there results a circulation which with strongly cohesive or adhesive material prevents the material from retaining its form and viscosity. Such material in the mixer according to the invention is, rather, unobjectionably thickened and advanced. In a corresponding manner the knives and guide paddles mounted in the housing operate in comminuting and feeding the material, whereby a circulation is set up in the material itself which for its part operates to obtain mixing. The result is a completely homogenized material in which foreign bodies are substantially comminuted so that the material can be pumped with pumps of different construction principles through conveyor pipes.

The invention also offers the advantage that viscous materials not thought of as pumpable up till now can be so mixed and thus treated that they become a homogenized medium pumpable through a pipe line, without it being necessary to control the output moisture content. This homogenization occurs also for example with sludges which frequently contain lumps and other crushable solid material. Advantageously also further occurs with the mixer according to the invention that the apparatus can be formed with a pressure or a closed housing and so arranged that the flow direction runs horizontal, inclined or vertical. Therefore the mixer according to the invention can connect in series immediately with a piston or screw pump.

Preferably and according to a further feature of the invention, the knives are provided with stationary breaking teeth on their blades for increasing the breaking action.

The stationary knife blades form with an embodiment of the invention segments of impeller surfaces, which run parallel to the surfaces of the knife impellers and the helical ribbon segments. In this way can the conveying action be controlled in the flow direction of the mixer The helical ribbon segments are with another embodiment of the invention fastened on the shaft extension by means of radial struts that have slanting surfaces employed in the flow direction.

Preferably further, the number of vanes of the knife impellers and the number of stationary knives arranged in a plane with respect thereto increase in the flow direction so that an increased homogenization through mixing of the material results as seen in the flow direction.

According to a further feature of the invention the leading edges of the knife blades are concavely bent and the knife backs convexly bent, and the blade edges of the stationary knives initially traversed from the shaft fastened knives are concave, while their rear edges are convexly curved. In this way, the rotating resistance of the shaft can be reduced and the motor power better utilized.

Preferably further, the guide paddles are formed to be adjustable from outside, so they can be arranged and adjusted to an optimal paddle position in each case for a particular material.

Figure 3:
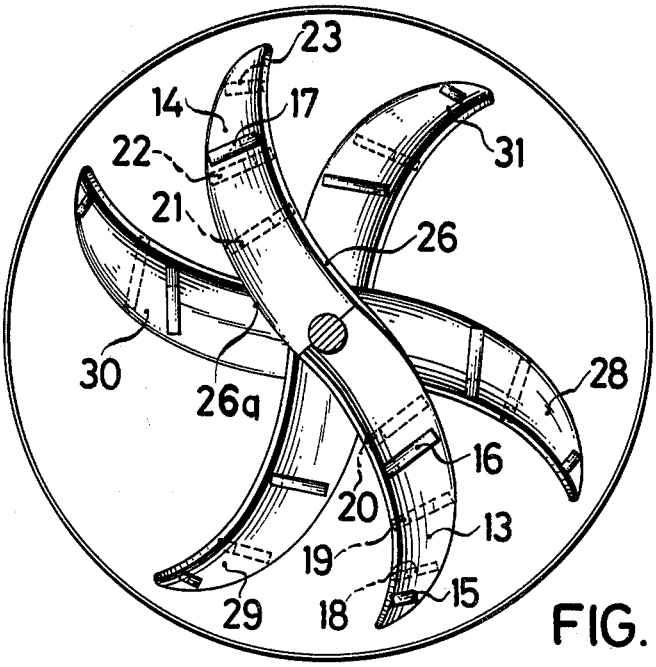
Figure 2:
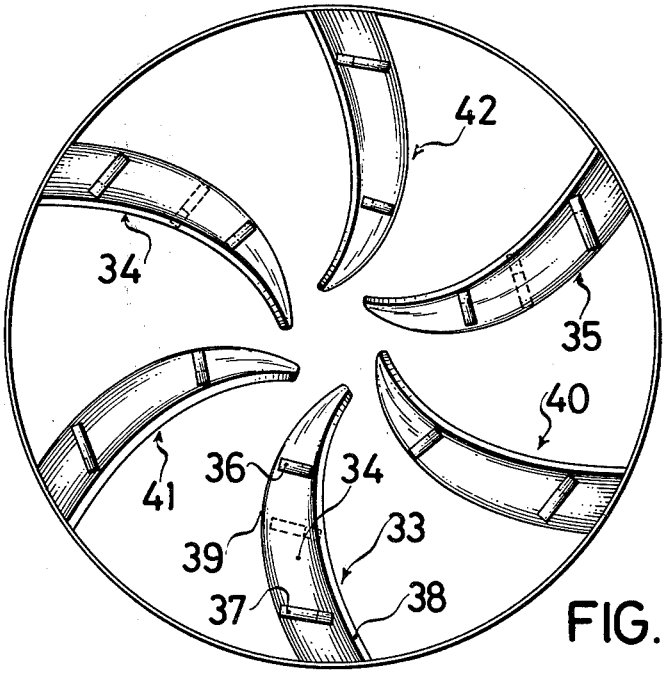
Figure 4:
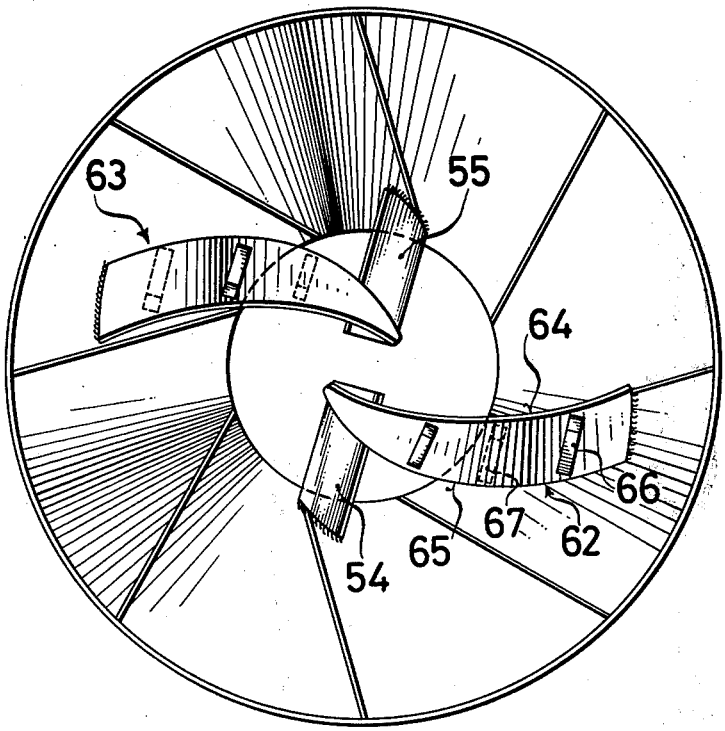
Figure 5:
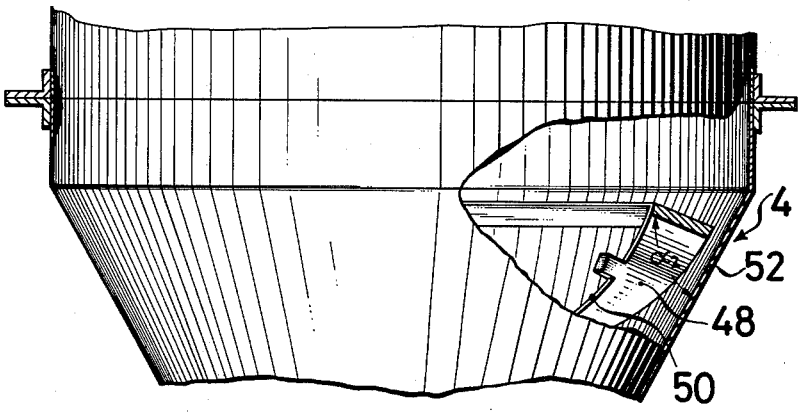

The details, further features, and other advantages of invention will become apparent from the following description of an exemplary embodiment with the aid of the figures of the drawing: which show FIG. 1 is a side view of an embodiment of the mixer according to the invention with a closed housing and a flow direction running perpendicularly from above to below, FIG. 2 is a plan view of the parts fastened to the housing in the upper mixer section, FIG. 3 is a plan view of the parts fastened representation of FIG. 2 with the shaft fastened parts in the upper housing section, FIG. 4 is a plan view of the housing fastened parts in the adjacent housing section, and FIG. 5 is a partially cut away side view reproducing the location of the mixer, in which the pair of housing parts connect to one another.

Figure 6:
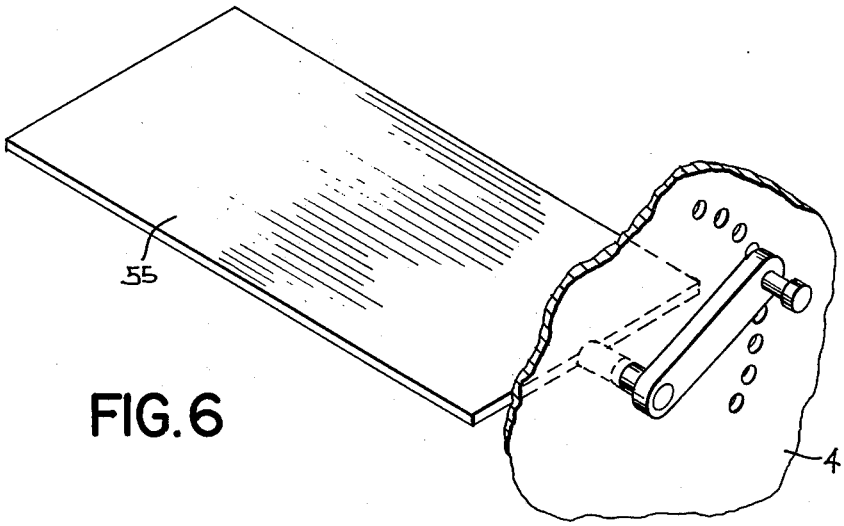

FIG. 6 is a fragmentary view showing adjustable guide paddles.

The mixer has an upper cylindrical section 1 of the housing indicated generally with 2, through which the material initially flows. The cylindrical housing section 1 is mounted at 3 to an in the flow direction converging, that is, conical housing 4. The output of the mixer at 5 flanged on to a pump 6 having a plurality of conveying cylinders, the details of which, as known are not shown.

On the cylindrical housing 1 rests a drive 7 that rotates a shaft 8, that projects at 9 into the converging housing section 4. The rotary direction of the shaft is represented by the arrow in FIG. 1, which is shown at the input of the converging housing 4.

The conveyed material received at 10 in the cylindrical housing is initially subjected to the action of a two vaned knife impeller 11. The two knife blades are shown in FIG. 3 by 13 and 14. The blades carry, on their upper surface, breaking teeth, that with the knife blade 13 are shown by 15 and 16 and with the knife blade 14 by 17. Also, the underside of the knife blades is provided with breaking teeth. These carry, in the case of the knife blade 13, the reference numbers 18–20 and with the blade 14, the references numbers 21–23. The breaking teeth are formed identically spaced apart from each other at predetermined distances along the length of the knife blade. They possess a concave leading edge 24 and an arched, that is convexly curved trailing edge 25. The knife blades are additionally inclined in correspondence to the representation according to FIG. 1 so that the knife blades upwardly slope from the respective leading edge 26 to the trailing edge 26*a*. The leading edge 26 for its part is, as can be appreciated from FIG. 3, concavely bent, while the trailing edge 26*c* has convex curves. These, in the example of the described embodiment with the knife blades 13 and 14, repeat also in a further knife impeller, having in this case four vanes, which is shown with 27 in FIG. 1 and whose knife blades are reproduced by 28–31 in FIG. 3.

The pair of knife impellers 11 and 27 are mounted in vertical, under one another planes I and III in cylindrical housing 1. Between the planes I and III, the planes II and IV lie under each other. In these planes are located the stationary breaking knives mounted on the housing. The number of breaking knives in the planes II and IV is the same.

As can be appreciated from FIG. 2, the breaking knives of the plane II are indicated by 33–35 and are arranged displaced at similar arcuate angles. Also these knives are provided on their blades 34 with breaking teeth 36 and 37, the form and size of which correspond to the breaking teeth on the associated knife blades of the knife impeller. Thereby the arrangement is so assembled that the blade edges 38 initially traversed from the shaft mounted knives are bent concavely and the trailing edges 39 are bent convexly.

In this embodiment, stationary knives 40–42 are correspondingly arranged in the plane IV that they therefore likewise displaced at similar arcuate angles are so mounted in the housing wall, that they can be traversed in the same way by the knives 28–31 of the knife impeller 27.

On the projection 9 of the shaft 8 in the converging housing portion 4, helical ribbon segments 48 and 49 are mounted by means of flat radial struts 46 and 47. The trailing edges 50, 51, contain respectively knife blades 52 and 53. As is apparent from FIG. 5, the plane of the helical ribbon segments 48, 49 embraces with the wall 52 of the tapered housing 4 an angle $\alpha$. This angle can be variously selected. If it becomes larger with respect to the horizontal, according to FIG. 5 as compared with FIG. 1, the compaction of the medium against the wall 52 of the funnel is reduced whereby the conveying effect in the direction of the discharge opening is simultaneously increased. One can also through suitable selection of the angle $\alpha$ determine the power requirement for the drive of the stirring shaft in correspondence to the conditions of the feed material.

In the housing 4 (FIG. 1) converging in the flow direction are found guide ribs 53, which are arranged on the inside of housing 4 spiral formed in the direction of rotation in the shaft and its extension 9. They coact with the guide paddles 54 and 55 fastened on the housing, which are arranged immediately in the discharge opening 56 of the housing.

Guide paddles 54 and 55 may be adjustable from the exterior of conical housing 4 so as to be adjustable for an optimal paddle position for a particular material, as shown in FIG. 6.

Above these guide paddles 54 and 55 lies thrust paddles fastened on the shaft. Three thrust 57–59 displaced 120° comprise a spiral 60 which compresses the material in the flow direction.

As FIG. 4 shows, knives 62, 63 displaced about a similar arcuate angle are located above the guide paddles 54 and 55 in a common radial plane, the configuration of knives 62, 63 corresponding to the stationary knives in the planes II and IV in the cylindrical housing. Consequently the blade edges 64 initially traversed by helical ribbon are concavely bent, the reverse edges 65 are however convexly bent. The upper surface and the undersurface of the knife blades are provided with breaking teeth 66 and 67, as has been explained above for the knife blades in the cylindrical housing section 1.

Between the planes and the parts fastened in the converging housing section 4 moves however not only the impeller 60. Above the stationary knives 62 and 63 are located on the shaft extension 9, further thrust paddles 70 and 71, while beneath the plane, in which the stationary knives 62 and 63 are arranged, thrust paddles 72 fastened to the shaft are arranged.

Thus, the number of the knife blades incorporated in the knife impellers 11 and 27 in the planes I and III are doubled so that the number of sections constructed from the knives are so sequentially divided that a few large sections in the beginning supply many small sections in the lower part of the cylindrical housing 1. The breaking teeth mounted on the knife blades accelerate the comminution. Increased comminution of the feed material along the knife blades from above to below in the cylindrical housing section is thus achieved which is increasingly employed from plane I to plane IV.

The material leaving cylindrical housing section 1 reaches the conically tapered housing section 4 initially in the action region of the helical ribbon that is its segments 48 and 49. These segments are arranged staggered by 180°, are approximately a quarter circle in size their contour results from that of the conical housing section 4. The flat struts 46 and 47 carried by them are likewise employed in the operating direction of the helical ribbon segments 48 and 49 and the actions originating from these elements are completed through the section of the ribs 53 already existing in the lower part. That leads to a desired thickening effect for lumpy or chunky material which prevents the retarding action of the ribs 53 and interruption of the conveying action in the flow direction. As with the helical ribbon segments 48 and 49, the following paddles 71, 72 and 57–59 now produce the necessary conveying effect in the flow direction. The stationary knife blades operate comminutingly in their turn with stiff plastic and strongly unhomogenious mediums. Finally the material passes in the region of the guide paddles 54 and 55 fastened on the housing; through these it is pressed out of opening 56.

In a modification of the illustration in the figures, a reversable opening can be provided in the housing wall. The thrust paddles 71, 72, and paddle 70 can be interchangeably mounted on the shaft.

We claim:

1. A mixer for low liquid content material, including filter cake, pulp, and the like, in which said material is initially comminuted and ground and thereafter mixed and thickened to render it pumpable, said mixer comprising:

a housing having a tubular portion (1) including an inlet at one end through which the material is received in the mixer;

a rotatable shaft (9) extending into said housing;

a first knife impeller (11) mounted in said tubular housing portion on said shaft for rotation therewith in a first plane (I);

a second, plural vane knife impeller (27) mounted on said shaft for rotation therewith in a second plane (III) spaced below said first plane;

first and second sets of stationary knives (33–35; 40–42) mounted on said tubular housing portion for coaction with said impellers, said first knife set being positioned in a plane (II) between said impellers, said second knife set being positioned in a plane (IV) below said second impeller, said impellers and stationary knives being mounted for mutual coaction to grind and comminute the material;

said housing having a frusto-conical portion mounted at the other end of said tubular portion and converging in the flow direction to an outlet through which the treated material is discharged;

a plurality of circumferentially spaced guide ribs (53) mounted in said conical housing portion;

a third set of stationary knives (63, 64) mounted in said conical housing portion;

guide paddles (54, 55) mounted in said conical housing portion below said third set of knives in the outlet of said conical housing portion;

helical ribbon segments (48, 49) mounted in said conical housing portion on said shaft for rotation therewith above said third set of knives; and thrust paddles (57–59, 70–72) mounted on said shaft above and below said third set of knives, said elements contained in said frusto-conical housing portion being mutually operatively associated to mix and thicken said material.

2. The mixer according to claim 1 wherein said stationary knives are provided with breaking teeth (36, 37; 66, 67).

3. The mixer according to claim 1 wherein said stationary knives are curved along their extension.

4. The mixer according to claim 1 wherein said impellers are provided with breaking teeth (15–23).

5. The mixer according to claim 1 wherein said helical ribbon segments are fastened to said shaft by means of radially extending struts (46, 47) having surfaces inclined to the material flow direction.

6. The mixer according to claim 1 characterized in that said second knife impeller (27) has a greater number of vanes than said first knife impeller (11).

7. The mixer according to claim 1 wherein the leading edges of said knife impellers are concavely bent and the trailing edges are convexly bent, and wherein the blade edges of said stationary knives initially transversed by said impellers are curved concavely and their trailing edges are curved convexly.

8. The mixer according to claim 1 wherein said guide paddles are so mounted on said housing as to be adjustable from the exterior of said mixer.

9. The mixer according to claim 1 in combination with a pump (6) mounted on the output of the converging housing portion (4), said mixer serving as a tamping device for the pump.

* * * * *